US007299951B2

(12) United States Patent
Jahnke et al.

(10) Patent No.: US 7,299,951 B2
(45) Date of Patent: Nov. 27, 2007

(54) FOOT ACTIVATED DISPENSER

(75) Inventors: Darren M. Jahnke, Lonsdale, MN (US); Wesley M. Nelson, Maplewood, MN (US); Joshua J. Lanz, North Branch, MN (US); Warren D. Pannkuk, Lakeville, MN (US)

(73) Assignee: Ecolab Inc., St. Paul, MN (US)

( * ) Notice: Subject to any disclaimer, the term of this patent is extended or adjusted under 35 U.S.C. 154(b) by 437 days.

(21) Appl. No.: 11/074,957

(22) Filed: Mar. 8, 2005

(65) Prior Publication Data

US 2006/0201973 A1 Sep. 14, 2006

(51) Int. Cl.
*B67D 5/42* (2006.01)

(52) U.S. Cl. ..... 222/179; 222/181.3; 222/209; 222/633; 222/321.8

(58) Field of Classification Search ..... 222/179, 222/181.1, 181.2, 181.3, 209, 631, 632, 633, 222/321.7, 321.8, 321.9
See application file for complete search history.

(56) References Cited

U.S. PATENT DOCUMENTS

| | | | | |
|---|---|---|---|---|
| 2,628,744 | A * | 2/1953 | Mowbray | 222/179 |
| 3,203,597 | A | 8/1965 | Birch | |
| 3,233,787 | A * | 2/1966 | Ross | 222/179 |
| 3,897,890 | A | 8/1975 | Jente | |
| 4,489,857 | A | 12/1984 | Batlas | |
| 4,615,476 | A | 10/1986 | Hobbs | |
| 4,651,902 | A | 3/1987 | Hobbs | |
| 4,679,709 | A | 7/1987 | Poitras | |
| D298,897 | S | 12/1988 | Blaich | |
| 4,957,218 | A | 9/1990 | Ford | |
| RE33,564 | E | 4/1991 | Ford | |
| 5,222,633 | A | 6/1993 | Blake | |
| 5,269,444 | A | 12/1993 | Wright | |
| 5,799,841 | A | 9/1998 | Wirt | |
| 5,897,031 | A | 4/1999 | Wirt | |
| 5,950,878 | A | 9/1999 | Wade | |
| 5,996,851 | A | 12/1999 | Dolan | |
| 6,041,974 | A | 3/2000 | Poitras | |
| 6,053,369 | A | 4/2000 | Hoang | |
| 6,131,773 | A | 10/2000 | Wade | |
| D436,859 | S | 1/2001 | Botsford | |
| 6,183,758 | B1 | 2/2001 | Scott | |
| 6,202,893 | B1 | 3/2001 | Rufini | |
| 6,248,085 | B1 | 6/2001 | Scholz | |
| 6,265,363 | B1 | 7/2001 | Viscovitz | |
| 6,267,976 | B1 | 7/2001 | Barnhart | |

(Continued)

FOREIGN PATENT DOCUMENTS

| | | |
|---|---|---|
| EP | 1211306 | 6/2002 |

(Continued)

*Primary Examiner*—Joseph A. Kaufman
(74) *Attorney, Agent, or Firm*—Andrew D. Sorensen; Anneliese S. Mayer

(57) ABSTRACT

The invention generally relates to a foot activated dispenser and more particularly to a foot activated dispenser for dispensing a liquid product such as a skin care product (i.e. hand soap, hand sanitizer, surgical scrub, lotion, etc.). More specifically, the foot activated dispenser includes a bladder connected to tubing that is connected to a piston pump. The piston pump is located within a shroud that is removably attached to a wall bracket. The wall bracket includes a bottle retainer for holding a bottle having a pump.

20 Claims, 12 Drawing Sheets

U.S. PATENT DOCUMENTS

| | | | | |
|---|---|---|---|---|
| 6,308,866 | B1 | 10/2001 | Hoang | |
| 6,321,943 | B1 * | 11/2001 | Strickler et al. | 222/82 |
| D452,099 | S | 12/2001 | Poitras | |
| 6,333,039 | B1 | 12/2001 | Fendler | |
| 6,367,662 | B1 | 4/2002 | Dorman | |
| 6,371,332 | B1 | 4/2002 | Fox | |
| 6,376,437 | B2 | 4/2002 | Viscovitz | |
| 6,427,875 | B1 | 8/2002 | Hoang | |
| 6,540,105 | B2 | 4/2003 | Dorman | |
| 6,652,135 | B2 | 11/2003 | Poitras | |
| 6,669,056 | B2 | 12/2003 | Bistolfi | |
| 2002/0000449 | A1 | 1/2002 | Armstrong | |
| 2002/0070240 | A1 | 6/2002 | Dorman | |
| 2003/0058734 | A1 | 3/2003 | Poitras | |
| 2004/0031816 | A1 | 2/2004 | Schuman | |
| 2004/0251271 | A1 | 12/2004 | Jackson | |

FOREIGN PATENT DOCUMENTS

| | | |
|---|---|---|
| EP | 0990412 | 3/2005 |
| WO | WO0174225 | 10/2001 |
| WO | WO03/005873 | 1/2003 |

* cited by examiner

FOOT ACTIVATED DISPENSER

FIELD OF THE INVENTION

The invention generally relates to a foot activated dispenser and more particularly to a foot activated dispenser for dispensing a liquid product such as a skin care product (i.e. hand soap, hand sanitizer, surgical scrub, lotion, etc.).

BACKGROUND

Dispensers for dispensing liquid products, such as hand soaps are generally known. See U.S. patent application Ser. No. 10/336,054 filed on Jan. 2, 2003. There are many types of dispensers, however, two common dispensers include a pump attached to a bottle, or a wall mounted dispenser. With a pump attached to a bottle, the product to be dispensed is located in the bottle (typically a plastic bottle) and a hand operated pump is attached to the bottle such that a user pushes on the top of the pump to dispense product out of the pump. With a wall mounted dispenser, the dispenser is operated by a user walking up to the dispenser and pushing a hand operated bar to dispense product.

These dispensers are often placed in locations where hand care is important, or where the likelihood of contacting microorganisms and other soils is high, for example in a public restroom or hospital facility. Over time, the surface that a user contacts to dispense product (i.e. the pump or the hand operated bar) becomes a source of germs and contaminants. Therefore, it is desirable to have a dispenser where operation of the dispenser is "hands free" so that a user does not have to touch the dispenser in order to dispense product.

It is against this background that the present invention has been made.

SUMMARY

The present invention is generally directed to a foot activated dispenser for dispensing liquid product such as hand soap, hand sanitizer, surgical scrub, lotion, and the like. An example of a liquid product is described in the patent application titled, HYDROALCOHOLIC ANTIMICROBIAL COMPOSITIONS WITH SKIN HEALTH BENEFITS, filed on Mar. 8, 2005 with the Ser. No. 11/075,287. The foot activated dispenser includes a bladder connected to tubing that is connected to a piston pump. The piston pump is located within a shroud that is removably attached to a wall bracket. The wall bracket includes a bottle retainer for holding a bottle having a pump. In operation, a user activates the dispenser by depressing the bladder with the user's foot, thereby sending air through the tubing to the piston pump. The air pushes the piston inside the pump down, thereby depressing the bottle pump head located on the bottle to dispense product.

The present invention has several advantages over the prior art. First, the pump is the component of the dispenser that will wear out most quickly. By locating the pump in the shroud, the pump may be serviced or replaced without replacing the entire dispenser. This is critical given the cost of the pump is a fraction of the cost of the whole dispenser. Second, the shroud is secured to the wall bracket by a latch with a catch. The shroud may be removed from the wall bracket by simply moving the latch. Tools are not necessary to remove the shroud which is desirable because tools can carry microorganisms and other soils and can damage the dispenser or create scratches that bacteria can grow on. Third, the bottle retainer provides a ledge for the bottle to sit on. The bottle retainer does not have any moving parts which makes it easy to use, and less likely to break. Fourth, by utilizing a bottle having a pump, the present invention allows the bottle to be used alone (i.e. on a counter) or in conjunction with the dispenser. Finally, by using a piston pump to depress the pump on the bottle, the length of the piston can be selected to make sure that a desired amount of product is dispensed every time.

These and various other features as well as advantages, which characterize the present invention, will be apparent from a reading of the following detailed description and a review of the associated drawings. It should be understood, however, that this summary, and the detailed description illustrate only some examples of various embodiments, and are not intended to be limiting to the invention as claimed.

DETAILED DESCRIPTION OF SOME EMBODIMENTS

Figure 1:
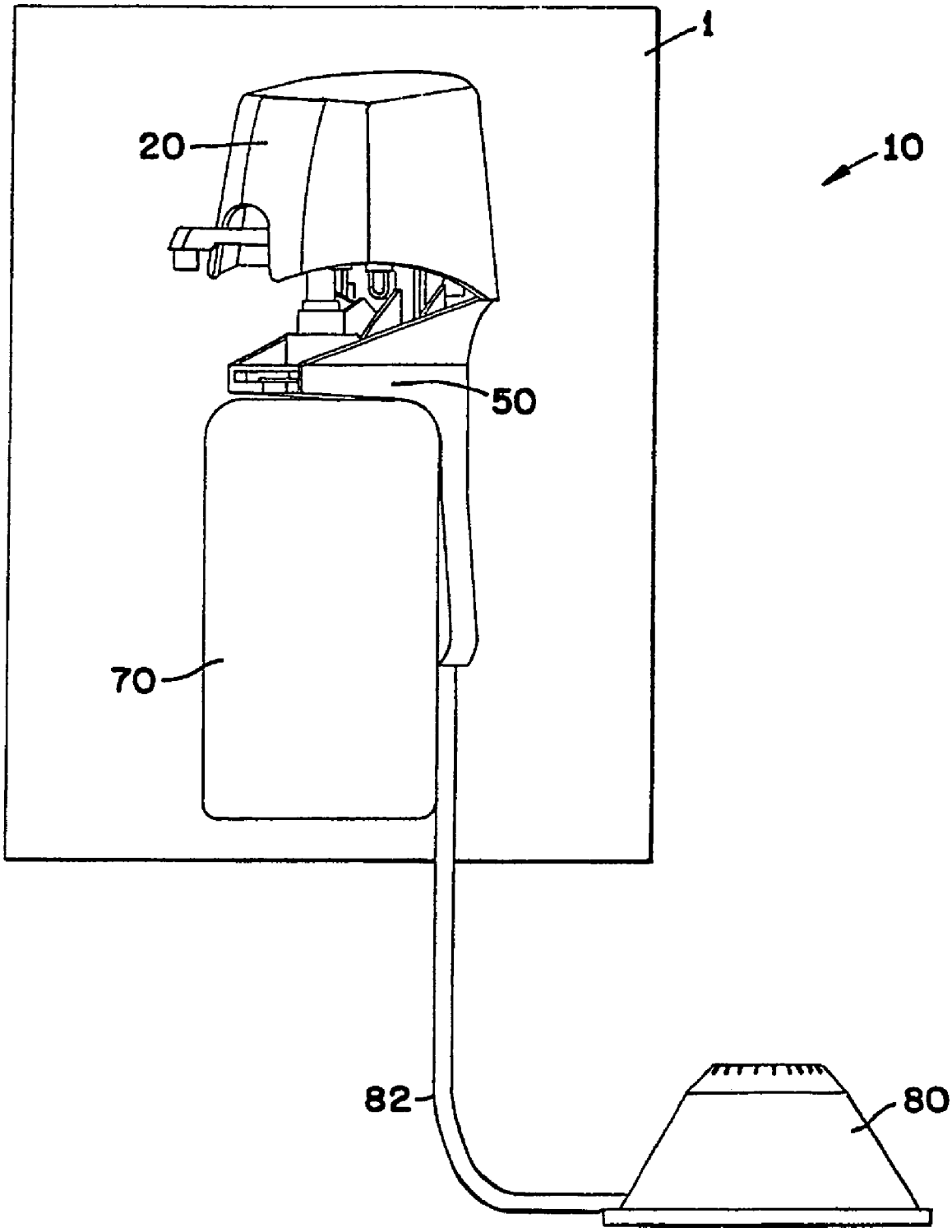
FIG. 1 illustrates the foot activated dispenser mounted to a wall generally including the bladder, the air tube, the wall bracket, the shroud, and the bottle.

The present invention and its various embodiments are described in detail below with reference to the figures. When referring to the figures, like structures and elements shown throughout are indicated with like reference numerals. Objects depicted in the figures that are covered by another object, as well as the reference annotations thereto, are shown using dashed lines.

In general, the present invention relates to a foot activated dispenser for dispensing a liquid product such as hand soap, hand sanitizer, surgical scrub, lotion, and the like. The components include, without limitation, a bladder, an air tube, a shroud, a wall bracket, a piston pump, a bottle retainer, and a latch. In some preferred embodiments, the dispenser is modular in that the shroud and pump can be easily removed individually or together and replaced with or without replacing the wall bracket.

Referring now to FIG. 1, the foot activated dispenser (10) is shown attached to a wall (1). The foot activated dispenser (10), (hereinafter referred to as "the dispenser"), includes a wall bracket (50) adaptable to be attached to the wall (1). A shroud (20) is removably attached to the wall bracket (50). The shroud contains the pump assembly (not shown) that activates the bottle pump on the bottle (70). The bottle (70) is held by the wall bracket (50). In operation, a user activates the bottle by stepping on the foot activated air bladder (80). Activating the bladder (80) causes air to go from the bladder (80), through the air tube (82) and to the pump assembly (not shown). The air causes the piston to move downward and this downward motion activates the bottle pump on the bottle (70), and thereby causes product to be dispensed.

The bladder is preferably a rubber or polymeric bladder that retains its shape after depression and releases air to the piston pump. The bladder is preferably a closed system in that no outside air is used to activate the piston pump. However, the bladder could introduce air from an open system or some electrical current could be generated to activate the pump. Finally, the bladder might be a mechanical device utilizing rods or combination of air and rods. The air tube is preferably medical grade PVC, low memory tubing. An example of suitable tubing includes the tubing sold under the name TYGON™.

The dispenser may be located anywhere hand care is desired. In some embodiments, the dispenser may be mounted to a wall, or other vertical surface, for example, a wall in a bathroom, a surgical preparation area, a hospital or nursing home patient room, kitchen, food or beverage plant and the like. In some embodiments, it may be desirable to mount the dispenser to a non-vertical surface such as on a countertop near a sink. Here, the dispenser may be mounted on a vertical surface attached to a non-vertical surface that may be mounted to a countertop.

Figure 2:
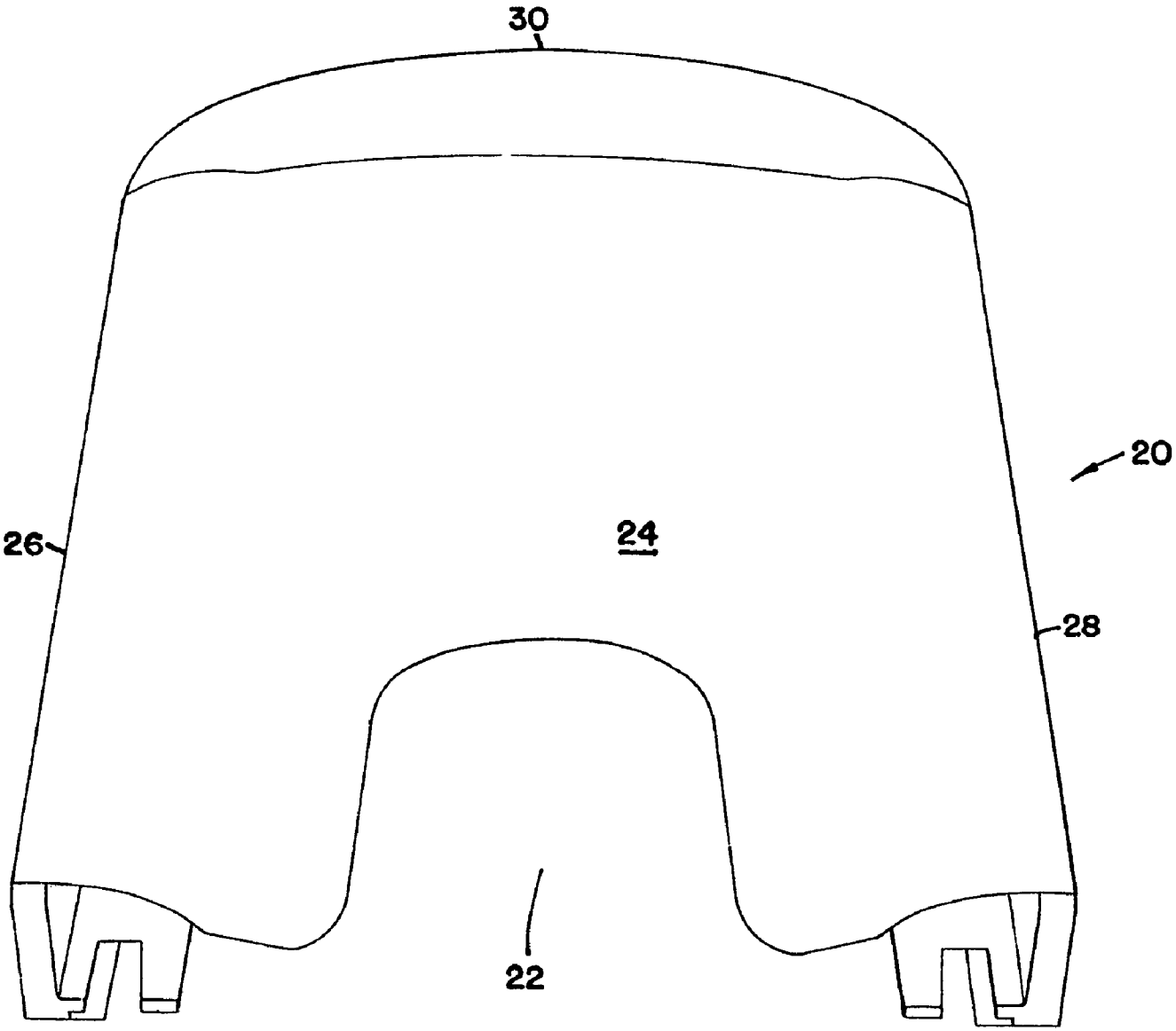
FIG. 2 illustrates in more detail, a front view of the shroud without the pump assembly.

Referring now to FIG. 2, a front close up view of the shroud (20) is shown. Shroud (20) has a front wall (24), a left side wall (26), a right side wall (28), and a top wall (30). In some embodiments, the front wall (24), the left side wall (26), the right side wall (28), and the top wall (30) may be straight or may be curved for aesthetic reasons. In some embodiments, the front wall (24) may include an aperture (22) to accommodate the bottle pump head (73) and the bottle pump spout (75). The shroud may be made of various materials including metal such as aluminum or steel, polymers such as polypropylene, high density polyethylene, low density polyethylene, and nylon, and resins such as acrylonitrile butadiene styrene. The shroud is preferably molded or injection molded and is preferably made out of a resin such as acrylonitrile butadiene styrene.

Figure 3:
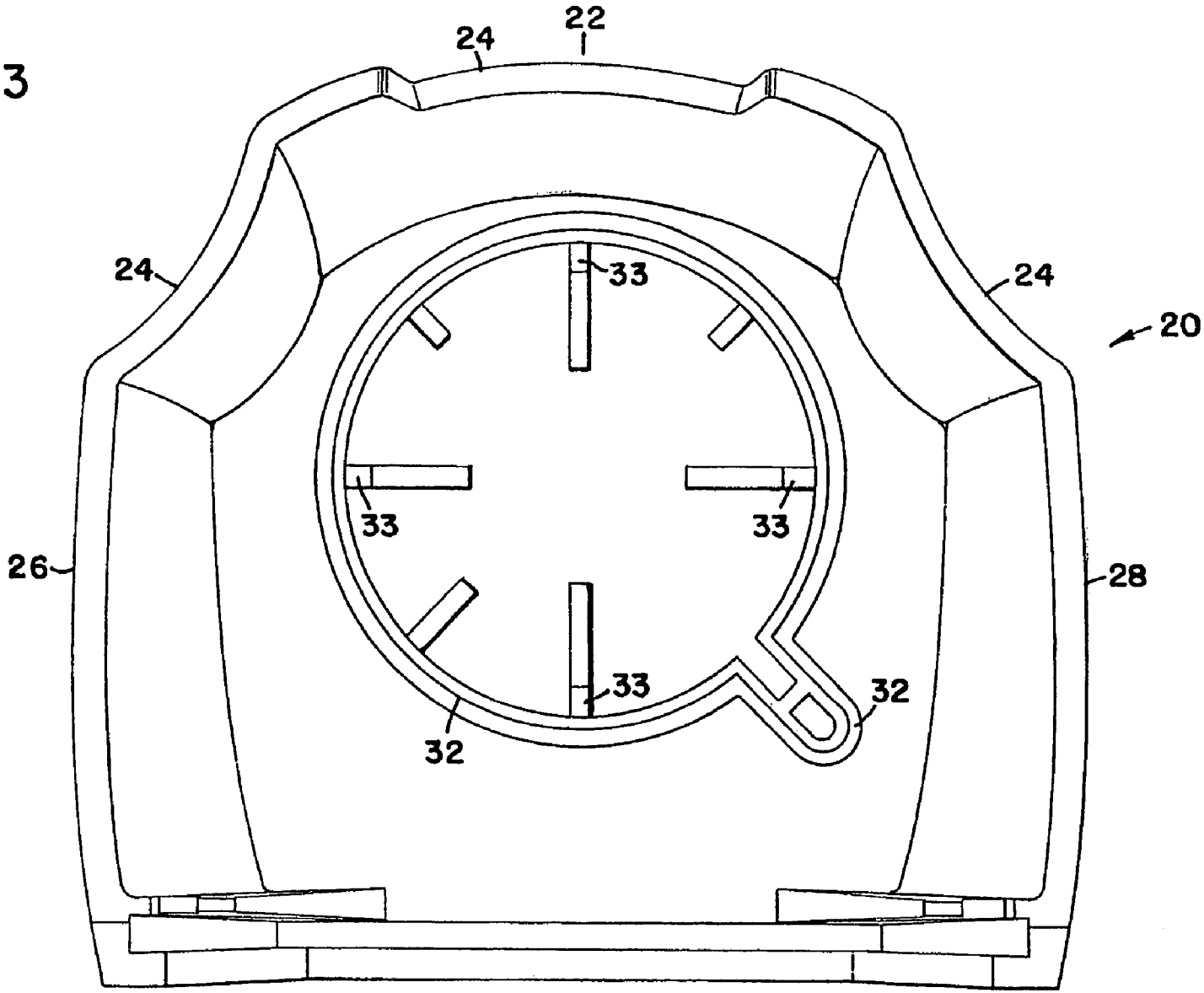
FIG. 3 illustrates in more detail, a bottom view of the shroud without the pump assembly.

FIG. 3 shows a bottom view of the shroud (20) without the pump assembly (40). FIG. 3 includes the shroud front wall (24), the left side wall (26), and the right side wall (28). The shroud (20) includes on the inside of the top wall (30) a pump assembly mounting ring (32). This pump assembly mounting ring (32) is shaped to accommodate the pump assembly (40) including the pump air inlet port (48) and the pump housing (46). When attaching the pump assembly (40) to the shroud (20), adhesive may be applied to the pump assembly mounting ring (32) and then the pump assembly (40), including the pump air inlet port (48) and the pump housing (46) may be set on the pump assembly mounting ring (32). Alternatively, the pump assembly (40) may be welded to the inside of the top wall (30), sealed, or attached using fasteners. Located within the pump assembly mounting ring (32) is at least one upper piston stop (33). The upper piston stop (33) provides smooth assembly and operation of the pump housing (46) and piston (44).

Figure 4:
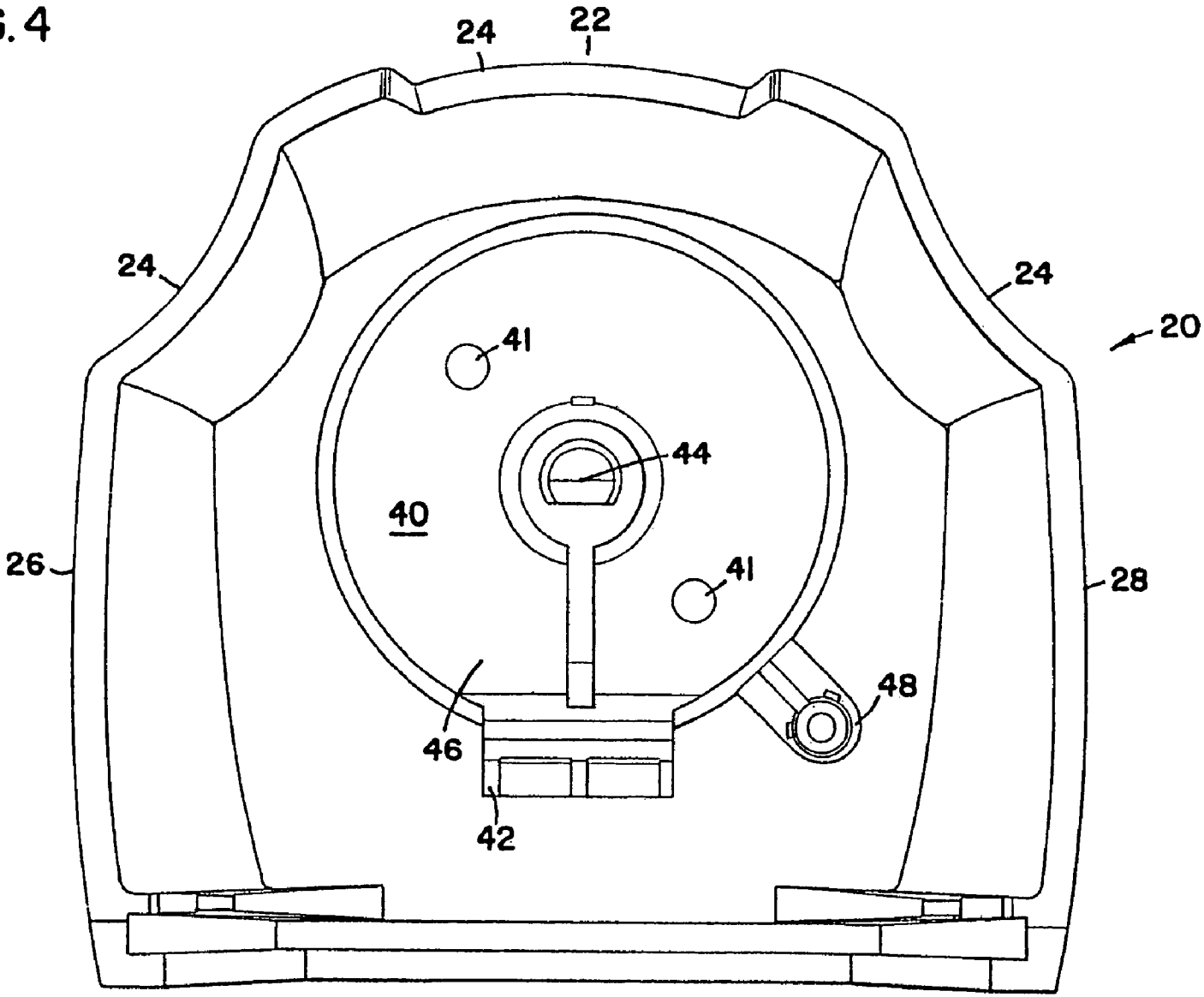
FIG. 4 illustrates in more detail, a bottom view of the shroud including the pump assembly.

FIG. 4 shows a bottom view of the shroud (20) with the piston pump (40). For clarification, the dispenser of the present invention includes two pumps—the piston pump (40) in the shroud (20) and the bottle pump head (73) on the bottle (70). The two pumps interact when the piston (44) contacts the bottle pump head (73) and pushes the bottle pump head (73) down to dispense product. The pump assembly (40) includes the pump housing (46), the pump air inlet port (48), and the latch (42). The air tube (82) connects to the pump air inlet port (48) to provide air from the bladder (80) to the pump assembly (40) and activate the piston (44) downward against the bottle pump head (73). The pump housing (46) optionally includes vent holes (41) for allowing smooth operation of the piston (44). The pump housing (46) also includes the piston (44). The piston may optionally include a piston shaft, however it is understood that other piston pumps are envisioned by the invention. As shown in FIG. 4, the piston (44), and specifically the piston shaft, preferably has a D-shaped cross-section. A D-shaped cross-section is advantageous because it prevents the piston (44) from rotating and consequently keeps the bottle pump head (73) straight during operation. However, any cross-section shape preventing rotation would suffice.

Figure 5:
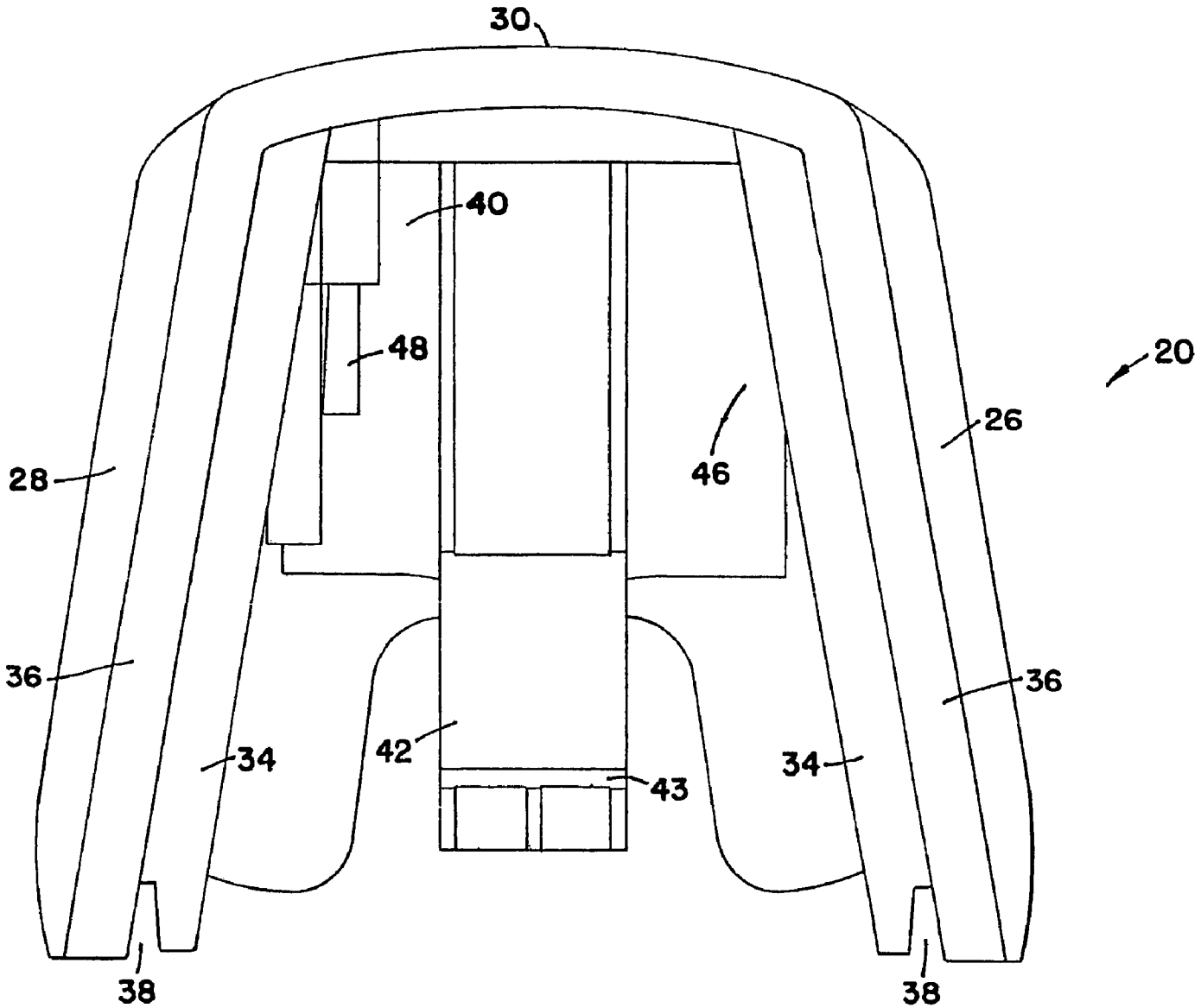
FIG. 5 illustrates in more detail, a back view of the shroud including the pump assembly.

FIG. 5 shows a back view of the shroud (20) with the pump assembly (40). The back of the shroud (20) includes a plurality of first edges (34) and a plurality of second edges (36) spaced apart from the first edge (34) to form a channel that coordinates with the skirt (59) on the wall bracket (50) to hold the shroud (20) on the wall bracket (50). It is understood that the shroud may include a plurality of first and second edges or one first edge and one second edge that is continuous. The first edge (34) includes an aperture (38). When the shroud (20) is connected to the wall bracket (50), the aperture (38) interlocks with the shroud tab (53) on the wall bracket (50). During operation, when the piston (44) pushes down on the bottle pump head (73), the aperture (38) and the shroud tab (53) interlock to prevent the left side wall (26) and the right side wall (28) from flaring out to the sides. This flaring out could cause the shroud (20) to disconnect from the wall bracket (50) without the aperture (38) and the shroud tab (53). In a preferred embodiment, the first and second edges (34) and (36), and the skirt (59) are tapered out to reduce the amount of vertical distance necessary to install the shroud (20).

Also shown in FIG. 5 is the pump assembly (40). The pump assembly (40) includes the pump housing (46), the pump air inlet port (48), and the latch (42). The latch (42) includes a catch (43). The latch (42) has a certain length to it and is preferably flexible so that when the shroud (20) is connected to the wall bracket (50), the catch (43) hooks on the end of the latch support (52) on the wall bracket (50). In some embodiments, the latch may include ribs to provide support for the latch. When the shroud (20) is removed from the wall bracket (50), the catch (43) may be moved away from the latch support (52) to allow the shroud (20) to slide off of the wall bracket (50). In a preferred embodiment, the catch and latch can be removed easily without the use of tools. For example, in some embodiments, it may take less than two minutes to remove the shroud from the wall bracket without the use of tools.

Figure 6:
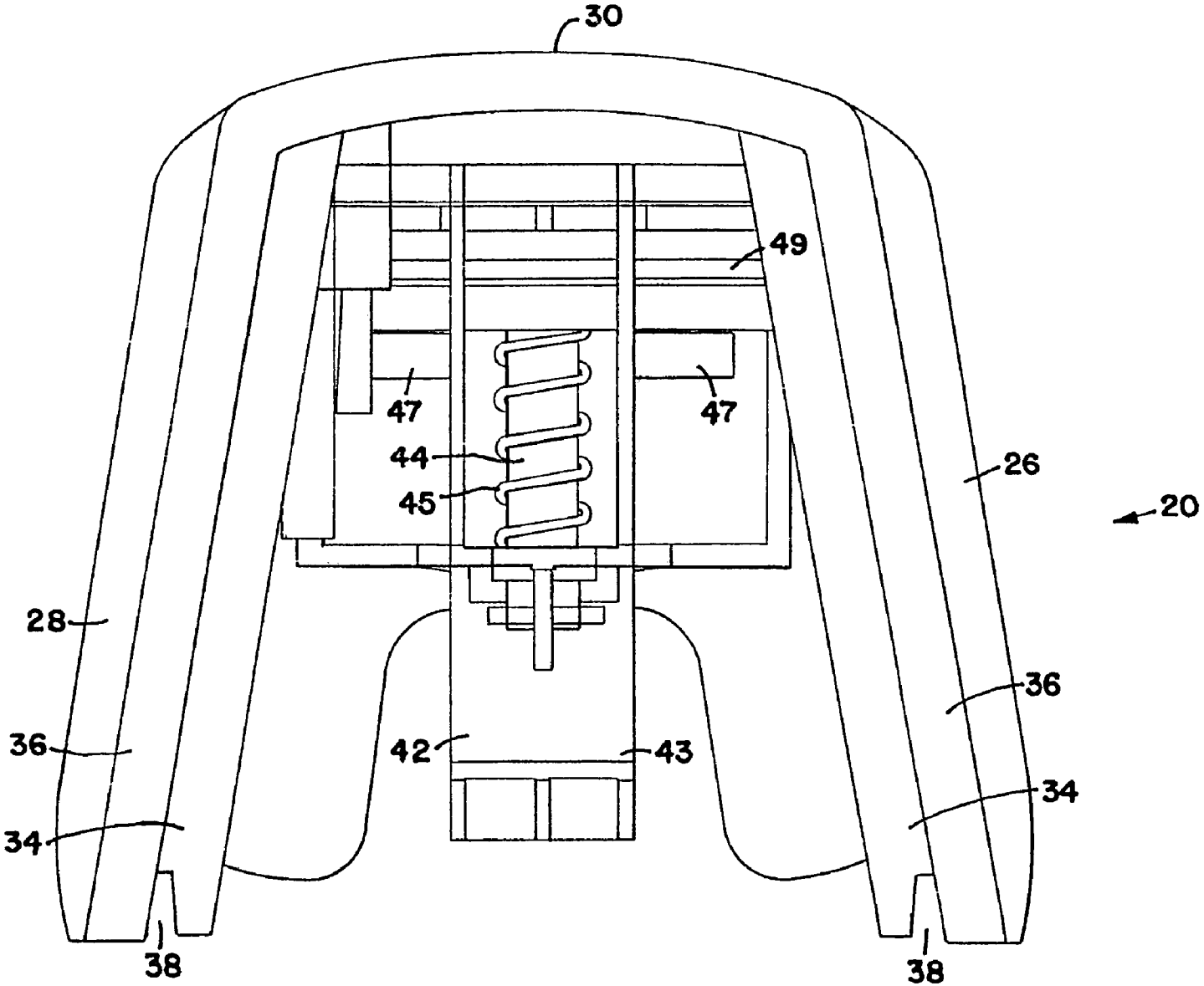
FIG. 6 illustrates in more detail, the pump assembly and the internal components of the pump assembly.
Figure 7:
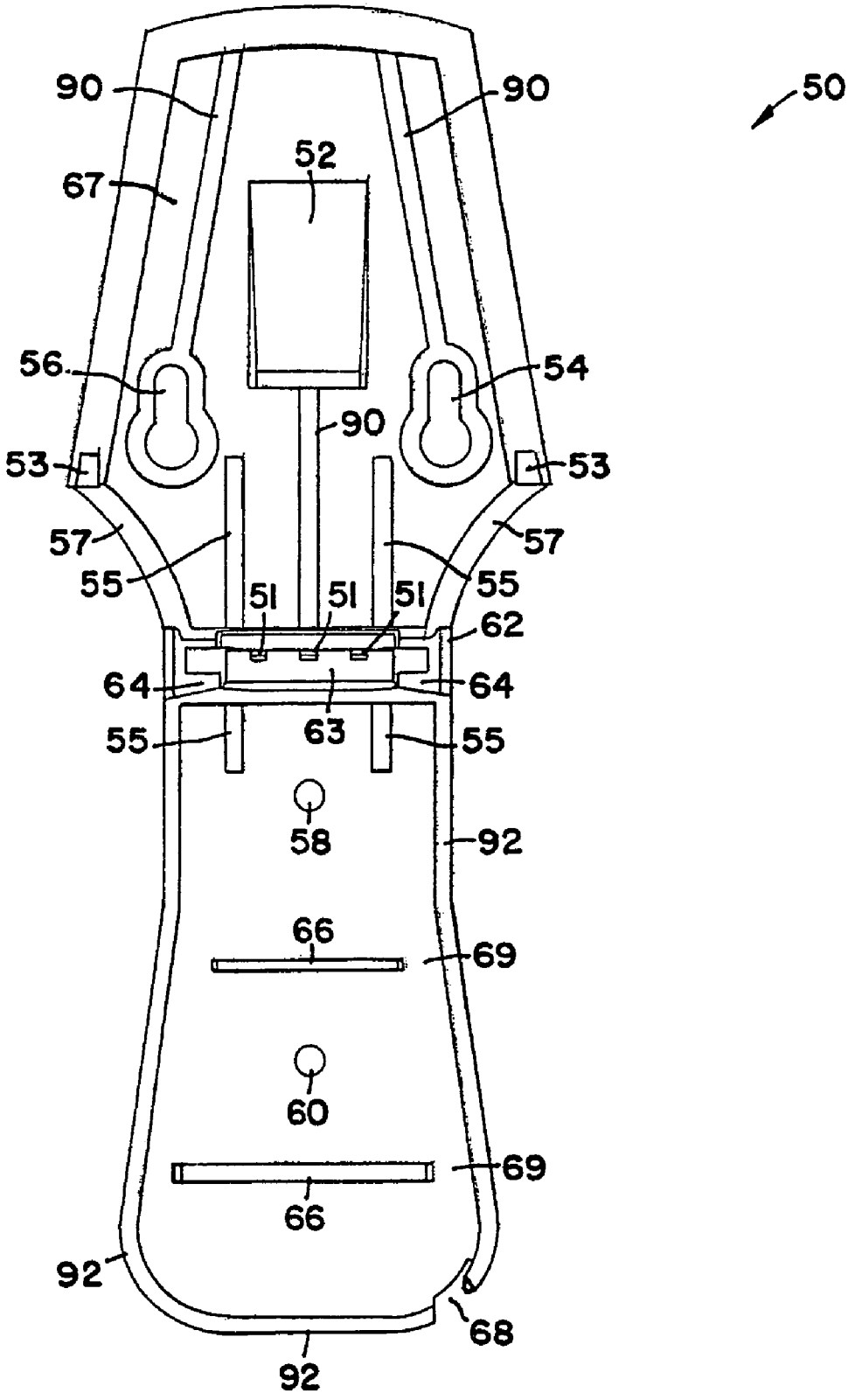
FIG. 7 illustrates in more detail, a front view of the wall bracket, without the shroud.
Figure 8:
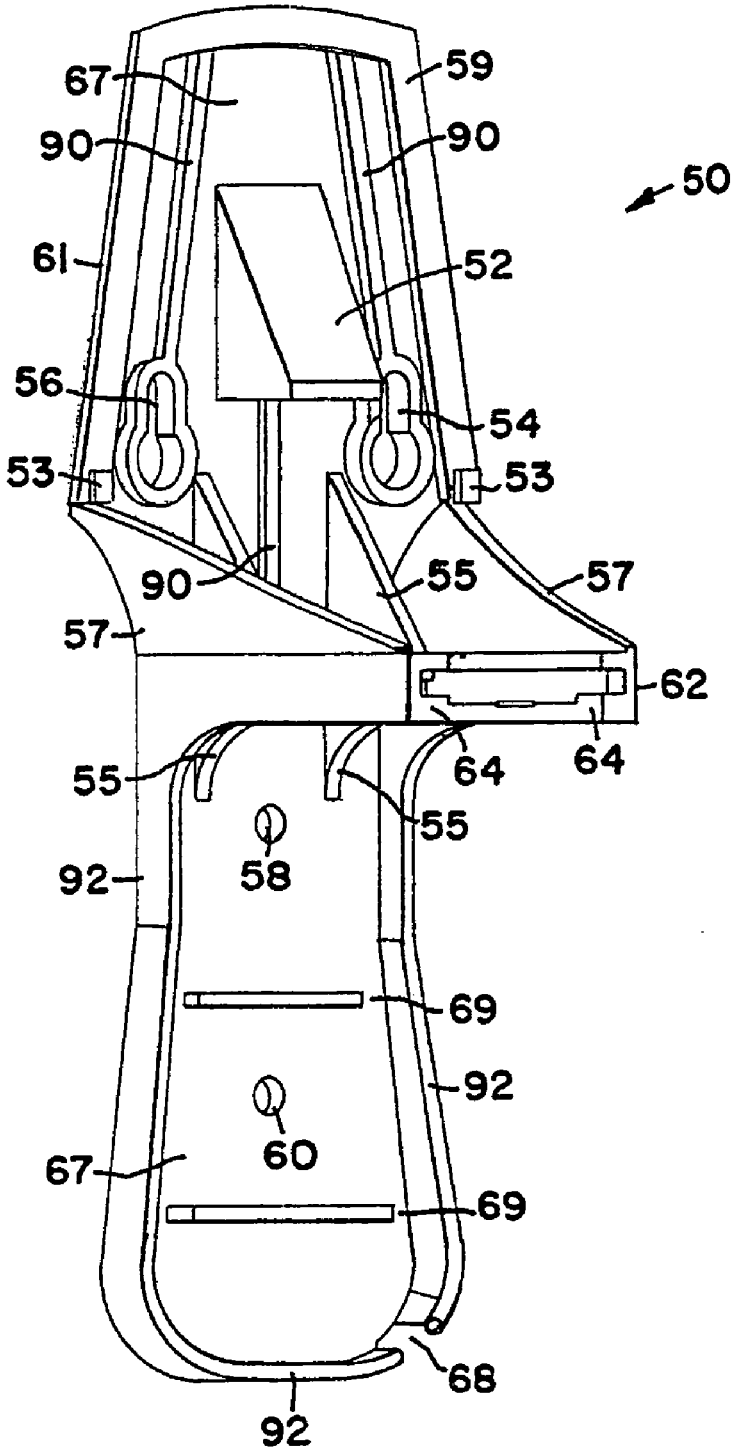
FIG. 8 illustrates in more detail, an angled view of the wall bracket, without the shroud.
Figure 9:
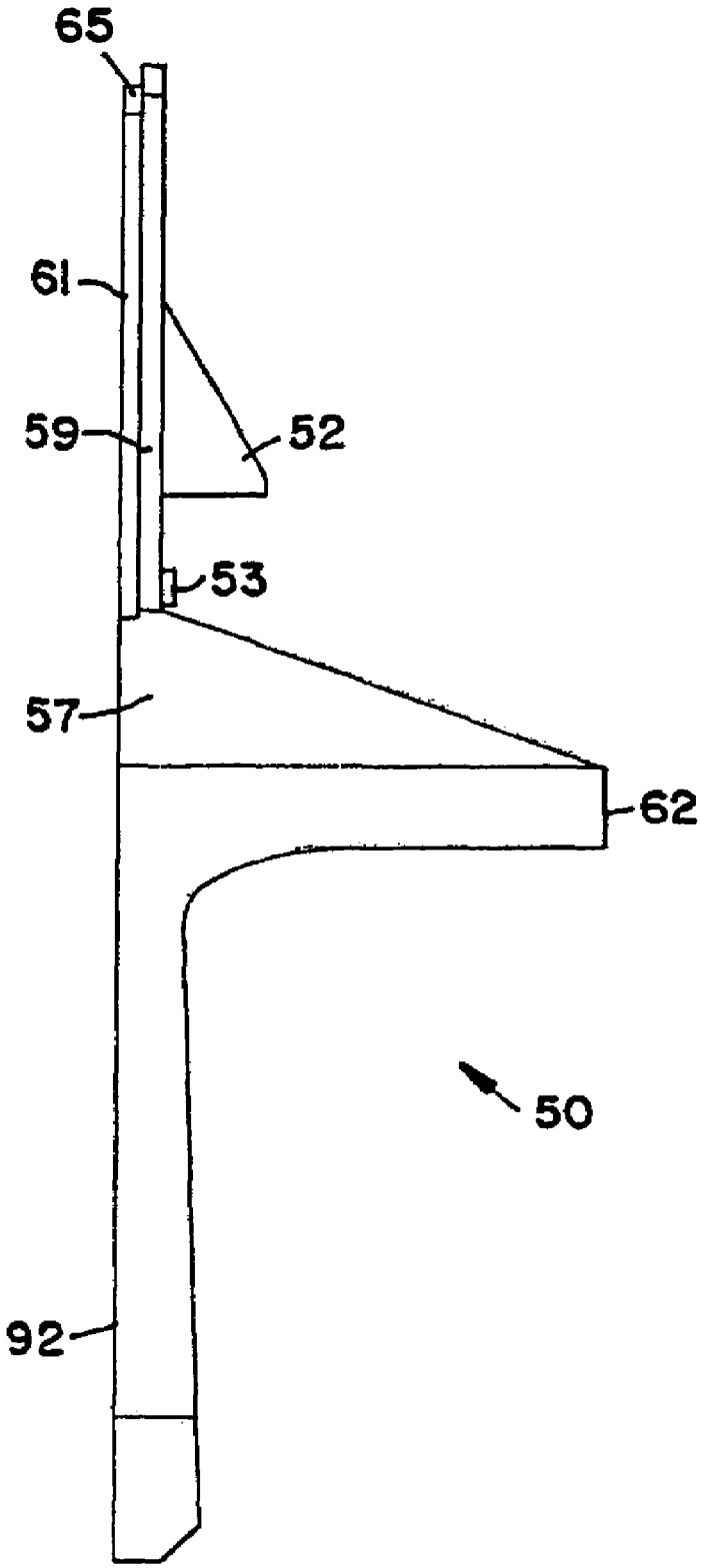
FIG. 9 illustrates in more detail, a side view of the wall bracket, without the shroud.

FIG. 6 illustrates in detail the pump assembly (40) and the internal components of the pump assembly (40). The pump assembly (40) includes a piston (44), a piston spring (45), a seal (49), a latch (42) and a catch (43). During operation, the bladder (80) sends air to the pump housing (46) and causes the piston (44) to move downward which depresses the bottle pump head (73). When the piston (44) is moved downward, the piston spring (45) compresses. When the bladder (80) is released, the air travels out of the pump housing (46) and into the air tube (82) and bladder (80), allowing the bladder (80) to return to the ready position, thereby releasing the pressure on the piston (44) allowing the piston spring (45) to expand and return the piston (44) to its resting position. The pump assembly (40) also includes at least one lower piston stop (47). The lower piston stop (47) prevents the piston (44) from over-traveling and damaging the bottle pump head (73) when the piston (44) is activated. The pump assembly (40) includes a seal (49) for allowing pressure to build on top of the piston (44), ultimately compressing the piston spring (45) and activating the pump. In some preferred embodiments, the piston has a stroke length of 0.700" or less.

Referring now to FIGS. 7-10, the wall bracket (50) is shown. The wall bracket (50) includes a wall bracket back wall (67), latch support (52), and a bottle retainer (62). The latch support (52) receives the catch (43) when the shroud (20) is placed on the wall bracket (50). The latch support (52), latch (42), and catch (43) are preferably designed so that the shroud (20) may easily be placed on the wall bracket (50) and may easily be removed from the wall bracket (50) without the need for tools. The wall bracket (50) may be made of various materials including metal such as aluminum or steel, polymers such as polypropylene, high density polyethylene, low density polyethylene, and nylon, and resins such as acrylonitrile butadiene styrene. The wall bracket is preferably molded or injection molded and is preferably made out of a resin such as acrylonitrile butadiene styrene.

The bottle retainer (62) is designed to have a certain height, width, and depth to receive the bottle retaining collar (78) on the neck (76) of the bottle (70), and hold the bottle (70) in place during use. The bottle retainer (62) includes a back wall (63) to prevent the bottle (70) from sliding too far back in the bottle retainer (62). The bottle retainer (62) preferably includes a plurality of elevated ledges (64) to lock the bottle (70) in place and prevent the bottle (70) from inadvertently falling out of the bottle retainer (62) during use. The elevated ledges (64) have a certain height and depth to them so that the bottle (70) may pass over the elevated ledges (64) and then drop down into the bottle retainer (62). Once the bottle (70) is resting in the bottle retainer (62), the elevated ledges (64) prevent the bottle (70) from being removed from the wall bracket (50) without lifting the bottle (70) up and over the elevated ledges (64). In a preferred embodiment, the bottle retainer (62) can include one or more vertical restraining members (51) for preventing vertical movement of the bottle (70) when the bottle (70) is resting in the bottle retainer (62). Because the piston (44) will be pushing on the bottle pump head (73) during operation, pressure will be exerted on the bottle retainer (62) during use. Accordingly, the bottle retainer (62) may optionally include a number of supports including a plurality of angled support ribs (55) and flared support ribs (57). These supports preferably prevent vertical and horizontal movement of the bottle retainer (62) during operation.

The wall bracket back wall (67) may include one or more mounting apertures (54), (56), (58), and (60) for mounting the wall bracket (50) to a wall (1) or other surface with fasteners such as screws or nails. In a preferred embodiment, the mounting apertures (54), (58), and (60) are placed to accommodate existing holes in the wall in the field. While the wall bracket back wall (67) may include mounting apertures, it is understood that the wall bracket may be mounted using tape or adhesive.

On the top portion of the wall bracket back wall (67) there is a skirt (59), a side wall (61), a top wall (65), and a plurality of shroud tabs (53). The skirt (59) is designed to receive the channel between the first edge (34) and the second edge (36) on the shroud (20) when the shroud (20) is placed on the wall bracket (50). The skirt (59) is spaced a certain distance from wall (1) by the side wall (61) and the top wall (65). This space should be at least large enough to accommodate the thickness of the second edge. The skirt (59) includes a plurality of shroud tabs (53) for receiving the apertures (38) on the shroud (20). As discussed previously, the purpose of the shroud tabs (53) and the apertures (38) is to prevent the sides of the shroud (20) from flaring out to the sides and disconnecting the shroud (20) from the wall bracket (50) during operation.

In some embodiments, the wall bracket back wall (67) includes below the bottle retainer (62) one or more bottle supports (66). The bottle supports (66) are preferably designed to have a radius that corresponds to the radius on the bottle (70). In some embodiments, the bottle supports (66) are placed on the wall bracket back wall (67) so that they allow for a space or aperture (69) on one side of the bottle support (66). This aperture (69) may be used as a pinch point for the air tube (82) to guide the air tube (82) up the side of the wall bracket back wall (67) and keep the air tube (82) out of the way of the bottle (70).

In some embodiments, the wall bracket back wall (67) may include a number of supports. For example, the wall bracket back wall (67) may include wall bracket ribs (90) or a wall bracket lip (92) to provide support. If a wall bracket lip (92) is used, the wall bracket lip (92) preferably includes an air tube guide (68) for allowing the air tube (82) to enter the wall bracket back wall (67). In some embodiments, the wall bracket lip (92) may be shaped on the bottom to accommodate the radius of the bottle (70).

Figure 10:
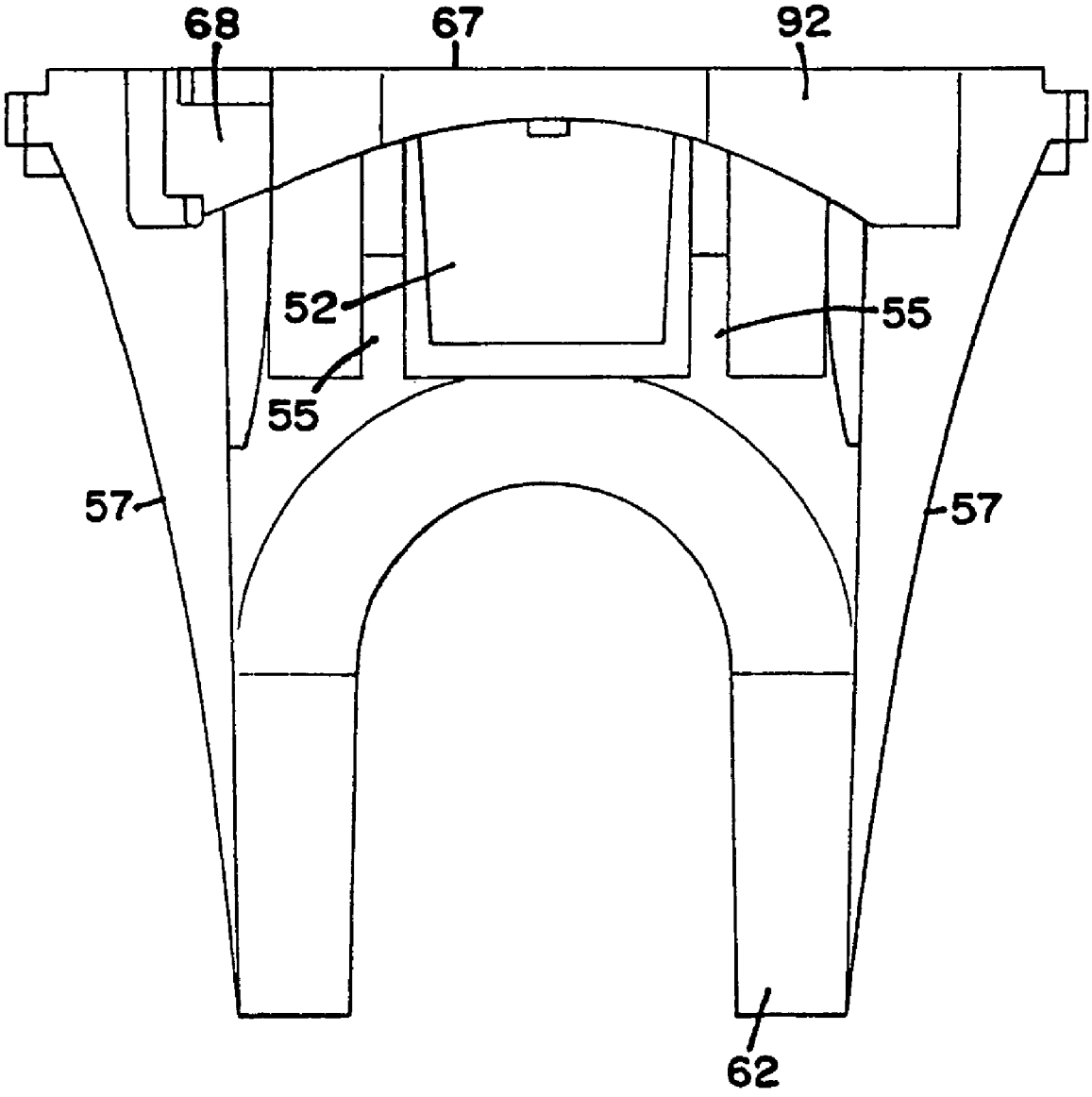
FIG. 10 illustrates in more detail, a bottom view of the wall bracket, without the shroud.

As shown in FIG. 10, the wall bracket (50) is preferably designed to minimize the number of upward facing surfaces. Upward facing surfaces collect dirt, dust, and other contaminants over time which is undesirable in the settings where the dispenser is intended to be used (i.e. hospitals, nursing homes, bathrooms, and the like). FIG. 10 is a bottom view of the wall bracket (50). FIG. 10 shows the space between the bottle retainer (62) and the wall bracket back wall (67). The plurality of angled support ribs (55) and flared support ribs (57) are located in this space.

Figure 11:
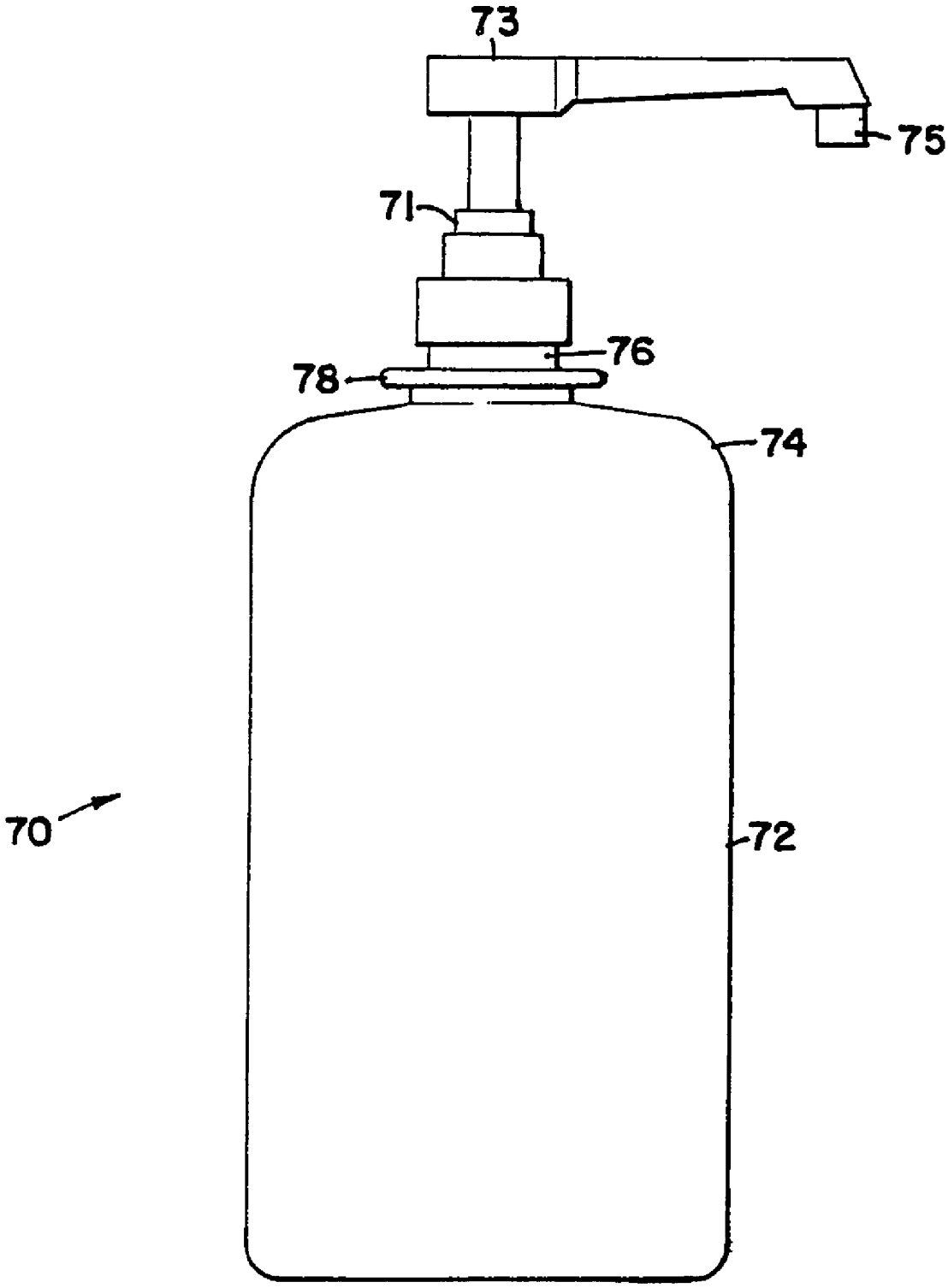
FIG. 11 illustrates a bottle.

Referring now to FIG. 11, the bottle (70) is shown. The bottle (70) includes a bottle body (72), a bottle shoulder (74), a bottle neck (76), a retaining collar (78) located on the bottle neck (76), and a bottle pump (71). The bottle pump (71) includes a bottle pump head (73) and a bottle pump spout (75). During operation, the piston (44) depresses the bottle pump head (73) causing product to dispense from the bottle pump spout (75). The bottle pump head (73) preferably has a diameter up to 5 inches, up to 3 inches, and up to 2 inches. In some embodiments, the bottle pump is capable of dispensing in one pump at least 10 milliliters of product, at least 5 milliliters of product, and at least 2 milliliters of product. The retaining collar (78) is designed to fit within the bottle retainer (62) and hold the bottle (70) on the wall bracket (50) during operation. The collar and retainer may be configured in many shapes to lock out products if desirable. An example of a suitable bottle is described in U.S. Pat. Nos. 4,651,902 and 4,615,576, which are incorporated by reference herein in their entirety. In some embodiments, the retaining collar preferably has a thickness of up to one inch, up to 0.5 inches, and up to 0.2 inches. In some embodiments, the retaining collar preferably has a depth up to 5 inches, up to 3 inches, and up to 2 inches. The bottle may be made of various materials including high density polyethylene, low density polyethylene, polyvinylchloride, and polypropylene.

Figure 12:
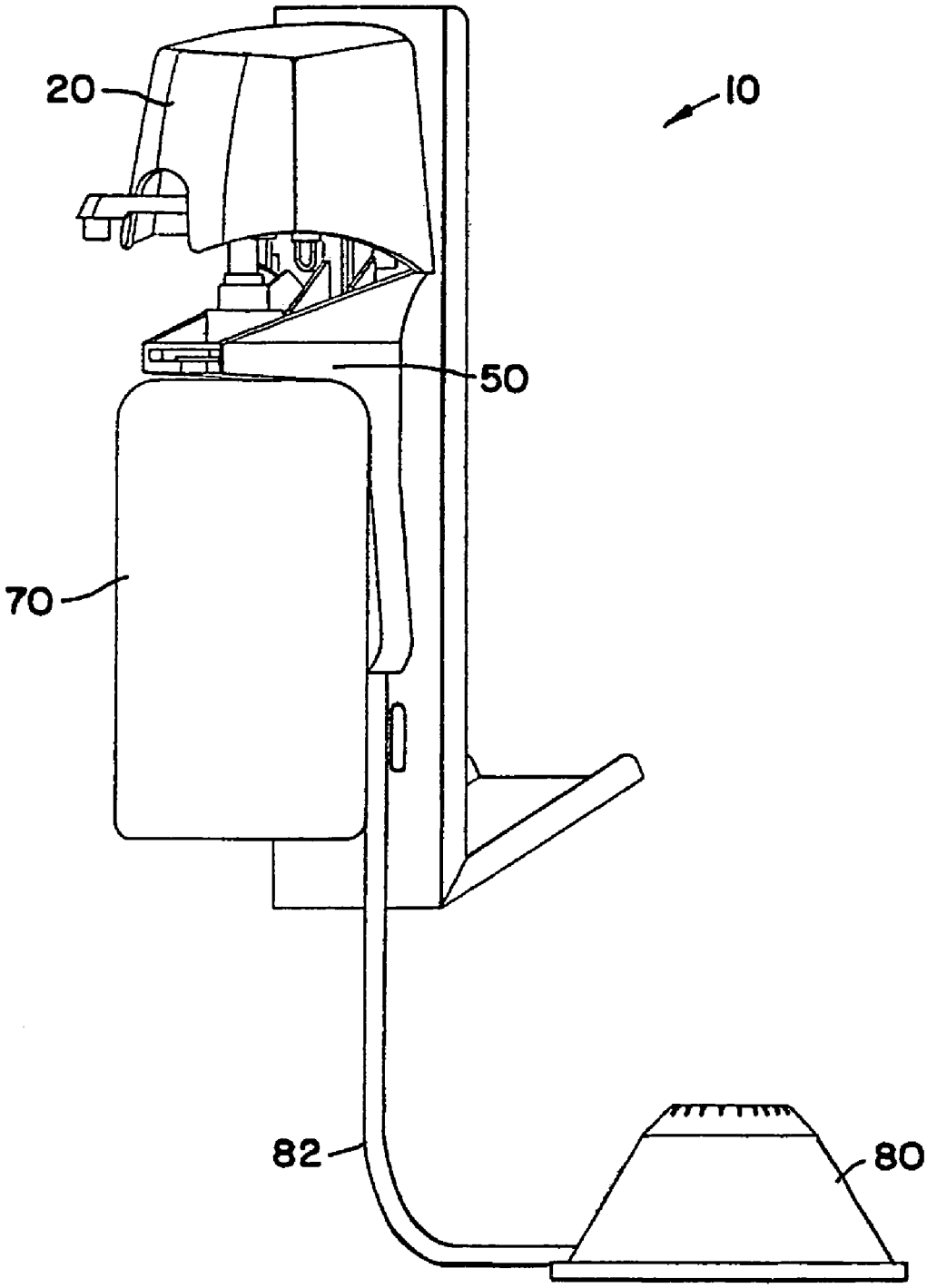
FIG. 12 illustrates the foot activated dispenser mounted to a horizontal surface generally including the bladder, the air tube, the wall bracket, the shroud, and the bottle.

Referring now to FIG. 12, the foot activated dispenser (10) is shown attached to a vertical surface other than a wall. For example, it may be desirable to attach the dispenser to a non-vertical surface such as the countertop in which case the dispenser may be mounted to a vertical surface, that is mounted to a non-vertical surface, that is attached to the countertop. The foot activated dispenser (10) includes a wall bracket (50) attached to the vertical surface. A shroud (20) is removably attached to the wall bracket (50). The shroud (20) contains the pump assembly (not shown) that activates the bottle pump on the bottle (70). The bottle (70) is held by the wall bracket (50). In operation, a user activates the bottle by stepping on the foot activated air bladder (80). Activating the bladder (80) causes air to go from the bladder (80) through the air tube (82), and to the pump assembly (not shown). The air causes the piston to move downward and this downward motion activates the bottle pump on the bottle (70), and thereby causes product to be dispensed.

The present invention has been described in the context of dispensing skin care products. However, it is understood that the present invention may be used wherever dispensers are used including in kitchens for dispensing pot and pan detergents, in laundries for dispensing laundry detergents, and for filling spray bottles or mop buckets with chemical concentrates or use solutions.

The foregoing summary, detailed description, and figures provide a sound basis for understanding the invention, and some specific example embodiments of the invention. Since the invention can comprise a variety of embodiments, the above information is not intended to be limiting. The invention resides in the claims.

What is claimed is:

1. A foot activated dispenser comprising:

a) a wall bracket adaptable to be attached to a vertical surface, the wall bracket comprising:
  a back wall;
  a latch support;
  a skirt;
  a side wall;
  a top wall; and
  a bottle retainer;

b) a shroud, removably attachable to said wall bracket, the shroud comprising:
  a front wall;
  a left side wall;
  a right side wall;
  a first edge; and
  a second edge;

c) a piston pump assembly attached to said shroud, the pump assembly comprising:
  a pump housing;
  a piston;
  a piston spring;
  a pump air inlet port;
  a seal;
  a latch; and
  a catch;

d) a bladder; and e) an air tube having one end in fluid communication with the interior of the bladder, and one end in fluid communication with the pump air inlet port.

2. The dispenser of claim 1, further comprising a bottle removably attachable to said bottle retainer, the bottle comprising:
  a bottle body;
  a bottle shoulder;
  a bottle neck having a retaining collar;
  a bottle pump head; and
  a bottle pump spout.

3. The dispenser of claim 1, wherein the bladder, the air tube, and the piston pump form a closed system.

4. The dispenser of claim 1, wherein the bladder is a rubber bladder.

5. The dispenser of claim 1, wherein the vertical surface is a wall.

6. The dispenser of claim 1, wherein the shroud further comprises an aperture in the front wall.

7. The dispenser of claim 1, wherein the shroud further comprises a pump assembly mounting ring.

8. The dispenser of claim 1, wherein the piston pump is attached to said shroud by welding, adhesive, seals, fasteners, and combinations thereof.

9. The dispenser of claim 1, wherein the shroud further comprises at least one upper piston stop.

10. The dispenser of claim 1, wherein the shroud is a material selected from the group consisting of metal, polymer, resin, and mixtures thereof.

11. The dispenser of claim 1, wherein the shroud is injection molded.

12. The dispenser of claim 1, wherein the shroud is acrylonitrile butadiene styrene.

13. The dispenser of claim 1, wherein the first edge and the second edge form a channel that receives the skirt on the wall bracket.

14. The dispenser of claim 1, wherein the first edge further comprises an aperture and the skirt further comprises a shroud tab wherein the aperture on the first edge receives the shroud tab when the shroud is placed on the wall bracket.

15. The dispenser of claim 1, wherein the wall bracket is a material selected from the group consisting of metal, polymer, resin and mixtures thereof.

16. The dispenser of claim 1, wherein the wall bracket is injection molded.

17. The dispenser of claim 1, wherein the bottle retainer further comprises a back wall.

18. The dispenser of claim 1, wherein the bottle retainer further comprises at least one elevated ledge.

19. The dispenser of claim 1, wherein the bottle retainer further comprises at least one vertical restraining member.

20. The dispenser of claim 1, wherein the shroud, wall bracket, and pump assembly are modular and can be independently replaced without replacing other parts of the dispenser.

* * * * *